US010570559B2

(12) United States Patent
Heo et al.

(10) Patent No.: US 10,570,559 B2
(45) Date of Patent: Feb. 25, 2020

(54) LAUNDRY DRYING APPARATUS

(71) Applicant: LG ELECTRONICS INC., Seoul (KR)

(72) Inventors: Seonil Heo, Seoul (KR); Yonghyun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 523 days.

(21) Appl. No.: 14/987,801

(22) Filed: Jan. 5, 2016

(65) Prior Publication Data

US 2016/0194815 A1 Jul. 7, 2016

(30) Foreign Application Priority Data

Jan. 5, 2015 (KR) ..... 10-2015-0000594

(51) Int. Cl.
*D06F 58/20* (2006.01)
*D06F 58/04* (2006.01)

(52) U.S. Cl.
CPC ..... *D06F 58/20* (2013.01); *D06F 58/04* (2013.01)

(58) Field of Classification Search
CPC ..... D06F 58/20; D06F 58/04; D06F 39/02; D06F 58/203; D06F 39/14; D06F 37/28; D06F 39/088; D06F 39/028; D06F 39/12; A47B 88/407; A47B 96/025; B60H 1/262; E06B 3/4672; E06B 5/01; B60J 5/06
USPC .... 34/603; 312/228, 326, 321.5, 138.1, 109, 312/330.1, 270.3, 139.2, 292, 298; 134/57 DL, 58 DL, 56 D, 58 D; 49/260, 49/130, 158, 239, 250, 370, 413, 157, 49/453, 208, 209, 213; 296/155; 68/196
See application file for complete search history.

(56) References Cited

U.S. PATENT DOCUMENTS

| | | | | |
|---|---|---|---|---|
| 4,911,497 | A * | 3/1990 | Schreiter | B60H 1/262 296/214 |
| 2006/0005581 | A1 | 1/2006 | Banba | |
| 2015/0143856 | A1 | 5/2015 | Jo et al. | |
| 2015/0191863 | A1* | 7/2015 | Kim | D06F 558/28 34/493 |

FOREIGN PATENT DOCUMENTS

| | | |
|---|---|---|
| CN | 1696384 | 11/2005 |
| CN | 101454499 | 6/2009 |
| CN | 204039759 | 12/2014 |
| CN | 104674513 | 6/2015 |
| EP | 1 467 015 | 10/2004 |
| EP | 2 199 453 | 6/2010 |
| EP | 2 878 727 | 6/2015 |

OTHER PUBLICATIONS

Chinese Office Action dated Jul. 4, 2017 issued in Application No. 201511021026.5.
European Search Report dated May 13, 2016 issued in Application No. 16 15 0073.1.

* cited by examiner

*Primary Examiner* — Edelmira Bosques
*Assistant Examiner* — Bao D Nguyen
(74) *Attorney, Agent, or Firm* — Ked & Associates, LLP

(57) ABSTRACT

A laundry drying apparatus provided herein may include a cabinet that includes an upper cover, a drum provided in the cabinet, an air supply unit configured to supply air to the drum and recover air from the drum, a reception unit configured to define an upper surface of the cabinet with the upper cover, and a reception space provided in the reception unit.

10 Claims, 9 Drawing Sheets

LAUNDRY DRYING APPARATUS

CROSS-REFERENCE TO RELATED APPLICATION

This application claims priority under 35 U.S.C. § 119 to Korean Application No. 10-2015-0000594, filed on Jan. 5, 2015, whose entire disclosure is incorporated herein by reference.

BACKGROUND

1. Field

Embodiments disclosed herein relate to a laundry drying apparatus.

2. Background

A laundry treatment apparatus generally may include a washing apparatus for washing laundry and a drying apparatus for drying laundry. The laundry drying apparatus is an appliance that uses high-temperature air for drying laundry, such as, e.g., clothing, which has been washed. A laundry drying apparatus may include a laundry container for accommodating laundry. Laundry is dried by supplying dry air to the laundry container and discharging moisture in the laundry container.

A laundry drying apparatus may be classified as a top loading-type apparatus or a front loading-type apparatus depending on how laundry is introduced into the laundry drying apparatus. The top loading-type laundry drying apparatus receives laundry from above, and the front loading-type laundry drying apparatus receives laundry from the front.

A laundry drying apparatus may also be classified as a condensation-type laundry drying apparatus, which circulates air to dry laundry, or an exhaust-type laundry drying apparatus, which discharges air to dry laundry. For example, the condensation-type laundry drying apparatus circulates air, which may have exchanged heat with the laundry in the drum and may have high humidity, without discharging the air outside the condensation-type laundry drying apparatus. The air may exchange heat with external air in a separate condenser, thereby condensing water, which may be subsequently discharged outside the condensation-type laundry drying apparatus.

A laundry drying apparatus may be used together with, for example, a washing apparatus. Detergent and functional additives required to perform a washing operation may be placed on an upper surface of the washing apparatus or the drying apparatus. In a laundry drying apparatus, extraneous substances, such as, e.g., coins or buttons, may be separated from laundry during drying. The extraneous substances are usually placed and stored in a separate location for the sake of subsequent reuse or repair, rather than being immediately discarded.

BRIEF DESCRIPTION OF THE DRAWINGS

The embodiments will be described in detail with reference to the following drawings in which like reference numerals refer to like elements wherein.

DETAILED DESCRIPTION

Figure 1:
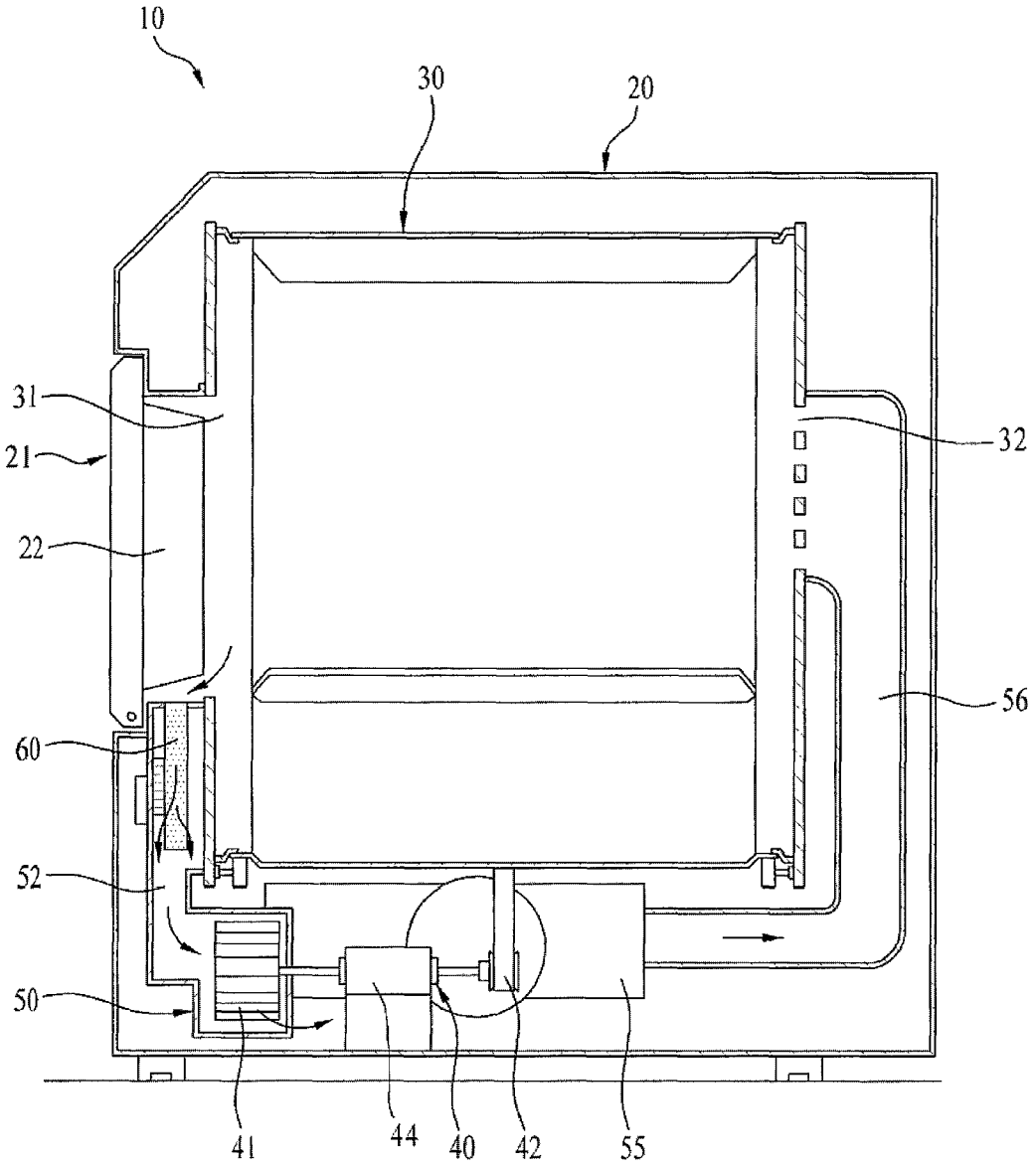
FIG. 1 RELATED ART
FIG. 1 is a cross-sectional view of a conventional laundry drying apparatus.

FIG. 1 is a cross-sectional view of a laundry drying apparatus. FIG. 1 is a schematic of an internal construction of a laundry drying apparatus. The laundry drying apparatus 10 may include a cabinet 20 defining the appearance of the apparatus, a drum 30 rotatably provided in the cabinet 20, an air supply unit 50 for circulating air so as to supply dry air to the drum 30 and recover the air from the drum 30, and a driving unit or driver 40 for supplying and transmitting power to the drum 30 and the air supply unit 50.

A door 21, through which items or clothes to be dried may be introduced into the drum 30, may be provided at or on a front surface of the cabinet 20. The door 21 may include a door glass 22 so as to allow an inside of the drum 30 to be visible from an outside of the cabinet 20. The door glass 22 may protrude inward in a direction of the drum 30 in order to prevent items or clothes drying in the drum 30 from moving toward the door 21.

The drum 30 may be in a shape of a cylinder having a drying space therein. An opening 31, through which clothes may be introduced and removed, may be provided at a front face of the drum 30. A plurality of air supply holes 32, through which air from the air supply unit 50 may be supplied to the drum 30, may be provided at a rear face of the drum 30.

The air supply unit 50, which may be provided under a front portion of the drum 30, may recover and heat air in the drum 30 and may supply heated air to the drum 30 through a rear of the drum 30. The air supply unit 50 may include a blower fan or blower 41 for air flow, a recovery duct 52 provided in front of the drum 30 to recover air from the drum 30, a heating duct 55 that communicates with the recovery duct 52 to heat air, and a condensation duct 56 connected to the heating duct 55 to condense moisture contained in the air.

The driver 40 may supply power required to drive the drum 30 and the air supply unit 50. The driver 40 may include a motor 44 as well as a power transmitting unit or transmitter 42, such as, e.g., a belt and a pulley, for transmitting power from the motor 44 to the drum 30. The blower 54 may be directly connected to the motor 44 so as to receive power from the motor.

The recovery duct 52 of the air supply unit 50 may include a lint filter 60 for filtering lint in the air recovered from the drum 30. The lint filter 60 may be provided in a front portion of the drum 30. The lint filter 60 may be removably mounted on the recovery duct 52 such that the lint filter 60 may be removed from the recovery duct 52 after the door 21 is opened.

The laundry drying apparatus 10 may be used together with, for example, a washing apparatus. Detergent and functional additives required to perform a washing operation may be placed on an upper surface of the washing apparatus or the drying apparatus 10.

In the laundry drying apparatus 10, extraneous substances, such as, e.g., coins or buttons, may be separated from laundry during drying. The extraneous substances may be placed and stored on or in a separate location for the sake of subsequent reuse or repair, rather than being immediately discarded.

Figure 2:
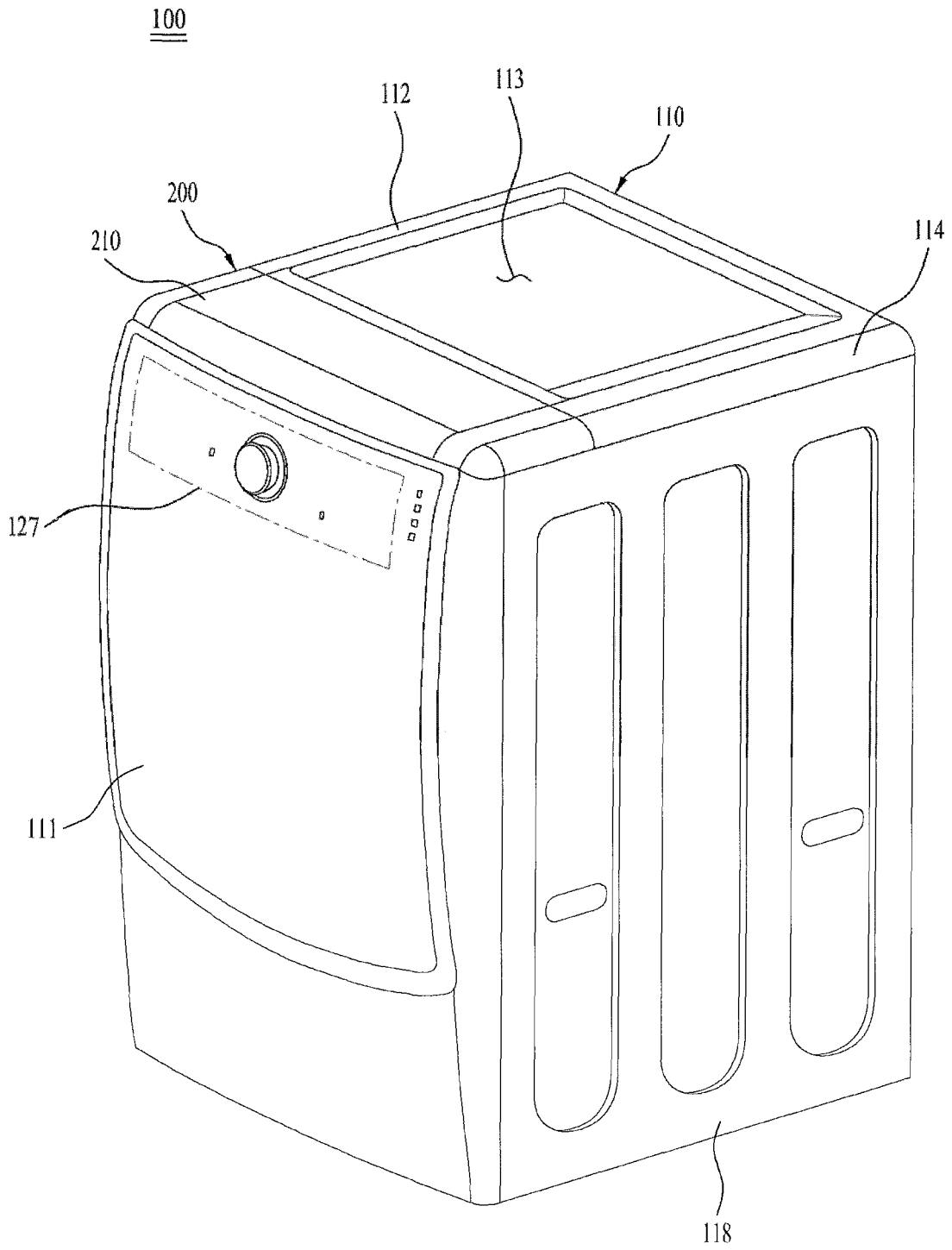
FIG. 2 is a perspective view of a laundry drying apparatus according to an embodiment disclosed herein.
Figure 3:
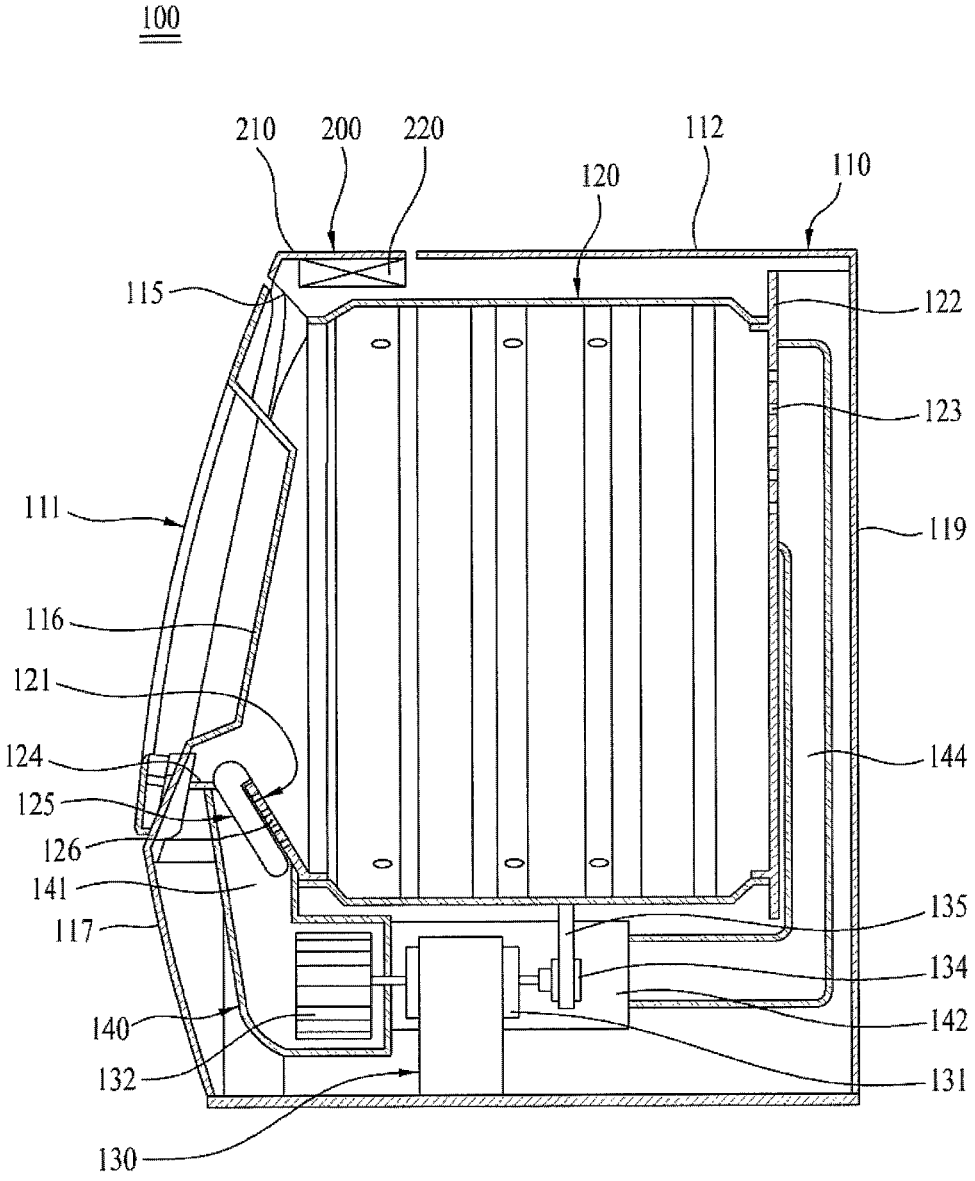
FIG. 3 is a schematic cross-sectional view of the laundry drying apparatus according to the embodiment.

FIG. 2 is a perspective view of a laundry drying apparatus according to an embodiment disclosed herein. FIG. 3 is a schematic cross-sectional view of the laundry drying apparatus according to the embodiment. A laundry drying apparatus 100 may include a cabinet 110, which may include an upper cover 112, a front cover 117, side covers 118 and a rear cover 119 so as to define an appearance of the laundry drying apparatus 100.

The laundry drying apparatus 100 may further include a drum 120, which may be rotatably provided in the cabinet 110, an air supply unit 140 configured to supply hot air to an inside of the drum 120, a driver 130 to supply rotational force to drive the driver 130 and the air supplying unit 140, and a reception unit 200 defining a portion of an upper surface of the cabinet 110 with the upper cover 112.

An upper portion of the cabinet 110 may be formed by the upper cover 112 and the reception unit or component 200, which define the portion of the upper surface of the cabinet 110. The reception unit 200 may define a front edge area of the cabinet 110 as well as the upper surface of the cabinet 110.

Figure 4:
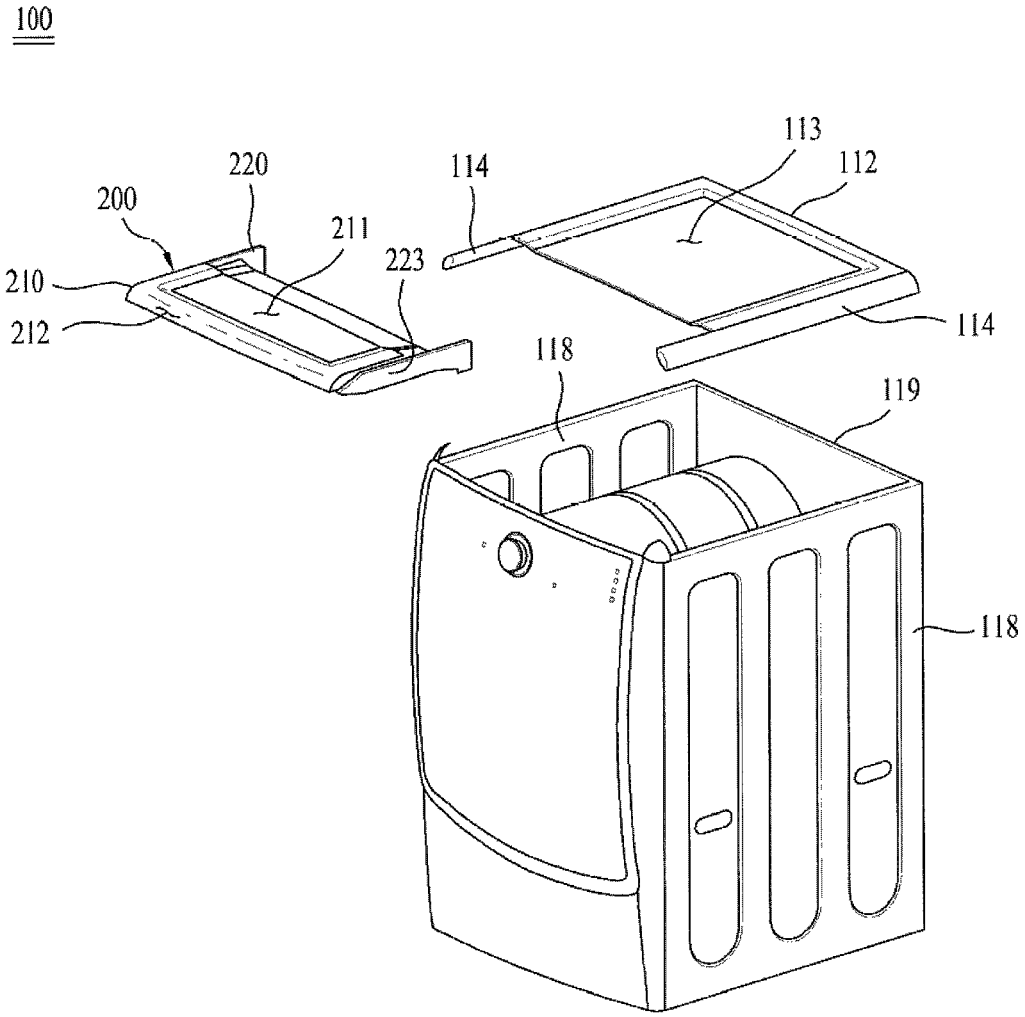
FIG. 4 is an exploded perspective view of an upper portion of the laundry drying apparatus according to the embodiment.

As shown in FIG. 4, the upper cover 112 of the cabinet 110 may include a recessed surface 113, which may be recesses in an inner area of the upper cover 112 to provide reinforcement, and a plurality of side panels 114, which may be provided on sides of the upper cover 112 so as to cover gaps between side covers 118 and the rear cover 119 and the upper cover 112.

An opening 115, through which items or clothes may be introduced, may be provided at or in the front cover 117 in an upper area of the cabinet 110. A door 111 may be provided at a lateral side of the opening 115. A door glass 116 may be provided at or on a center of the door 111 to allow an inside of the drum 120 to be visible. The door glass 116 may protrude toward the inside of the drum 120.

The door 111 may be mounted on the front cover 117 so as to be inclined at a predetermined angle. An angle of inclination of the door 111 may be such that an upper portion of the door 111 may be inclined towards a rear of the cabinet 110. When the door 111 is mounted at an incline, a user may introduce laundry into the laundry drying apparatus 100 or may take laundry out of the laundry drying apparatus 100 without having to stoop down as far as when the door 111 is vertically mounted, thereby offering convenience to the user.

A control panel 127, at which operations, such as, e.g., washing and drying, may be input and executed, may also be provided on the upper area of the front surface of the door 111. The control panel 127 may include a controller that allows a user to select procedures to operate the laundry treating apparatus 100, and a display that displays the procedures to operate the laundry drying apparatus 100.

The door 111 may be mounted on the front cover 117 via a hinge unit or hinge. The hinge may exert a predetermined biasing force upon opening or closing the door 111. If the door 111 is mounted on the front cover 117 and inclined at a predetermined angle, the door 111 may unintentionally rotate due to its own weight when opening or closing the door 111. According to embodiments disclosed herein, an elasticity of the hinge unit may prevent the door 111 from unintentionally rotating due to its own weight.

The drum 120, which may be rotatably provided in the cabinet 110, may include a front plate 121 for rotatably supporting the front part of the drum 120, and a rear plate 122, which may be coupled to the rear part of the drum 120 so as to rotatably support the rear part of the drum 120. The front plate 121 of the drum 120 may rotatably support the front end of the drum 120 and allow the opening 115 in the front cover 117 to communicate with the drum 120.

A lint filter mount 124, on which a lint filter 125 may be mounted, may be provided at a lower portion of an inside of the opening 115. A recovery duct 141 of the air supply unit 140 may be connected to a lower portion of an outside of the opening 115. The lint filter 125 may be mounted on the lint filter mount 124 such that an upper portion of the lint filter 125 may be exposed. Therefore, lint in the air from the drum 120 may be filtered by the lint filter 125 while the air in the drum 120 flows into the recovery duct 141. The lint filter 125 may be provided so as to be removably mounted on the lint filter mount 124 of the front plate 121 and to be removed from the front plate 121 through the opening 115.

An air recovery unit 126, which may have a plurality of through holes therein to allow the air in the drum 120 to be introduced through a side inlet of the lint filter 125, may be provided on or at a side of the lint filter mount 124 of the front plate 121. The air recovery unit 126 may enable an amount of air introduced into the lint filter 125 to increase, thereby improving the filtering efficiency of the lint filter 125.

The opening 115 of the front plate 121 may be configured to be depressed or recessed toward the door 111 when viewed from inside the drum 120, and the door glass 116 of the door 111 may be configured to protrude into the drum 120 from the opening 115.

The rear plate 122 of the drum 120 may rotatably support the rear end of the drum 120 and may supply air from the air supply unit 140 to the inside of the drum 120. The rear plate 122 may be provided with a plurality of air supply holes 123 formed in a predetermined area thereof. A condensing duct 144 of the air supply unit 140, which may communicate with the air supply holes 123 to supply air to the air supply holes 123, may be provided on an outer surface of the rear plate 122.

An inner surface of the front plate 121 and an inner surface of the rear plate 122, which may face each other, may be respectively provided with a roller-shaped front support and a roller-shaped rear support so as to rotatably support the drum 120 provided between the front plate 121 and the rear plate 122.

The driver 130, which may drive a blower 132 of the air supply unit 140, may include a motor 131. The blower 132 of the air supply unit 140 may be coupled to a first end of the rotating shaft of the motor 131, and a pulley 134 may be coupled to a second end of the rotating shaft of the motor 131 to transmit rotational force to the drum 120. The drum 120 may be connected to the pulley 134 by a belt 135 in order to receive the rotational force of the motor 131.

As the motor 131 of the driver 130 rotates, the drum 120 and the blower 132 of the air supply unit 140 may operate simultaneously. Alternatively, the drum 120 and the blower 132 may be driven by respective motors.

The air supply unit 140 may recover and heat the air in the drum 120 and supply the heated air to the drum 120 again. The air supply unit 140 may include the recovery duct 141, which may communicate with the front plate 121 of the drum 120 to recover the air in the drum 120, the blower 132, which may communicate with the recovery duct 141 to transfer air, a heating duct 142 including a heater for heating air transferred by the blower 132, and a condensation duct 144 for condensing moisture contained in the air heated by the heating duct 142 to create heated and dry air and guiding the heated and dry air toward the drum 120.

The recovery duct 141 may be connected to a lower area of the outer surface of the front plate 121 of the drum 120. For example, the recovery duct 141 may be connected to a lower portion of the lint filter mount 124 provided at the opening 115. Accordingly, the recovery duct 141 may provide a lint filter space in which the lint filter 125 mounted on the lint filter mount 124 may be installed.

The air supply unit 140 may be embodied as a circulation-type air supply unit or as an exhaust-type air supply unit. Although the air supply unit has been described as having a heater, an air supply unit that heats air using a refrigerant in the manner of a heat pump may also be applied.

Figure 5:
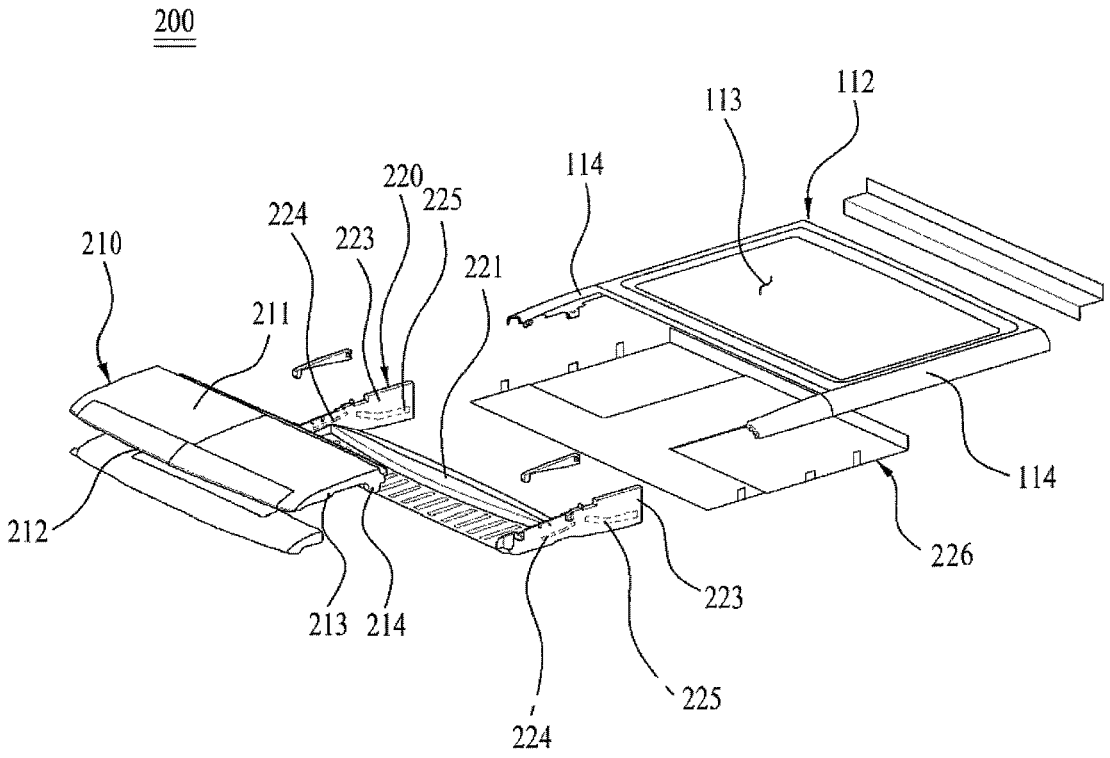
FIG. 5 is an exploded perspective of a reception unit of the laundry drying apparatus according to the embodiment.
Figure 6:
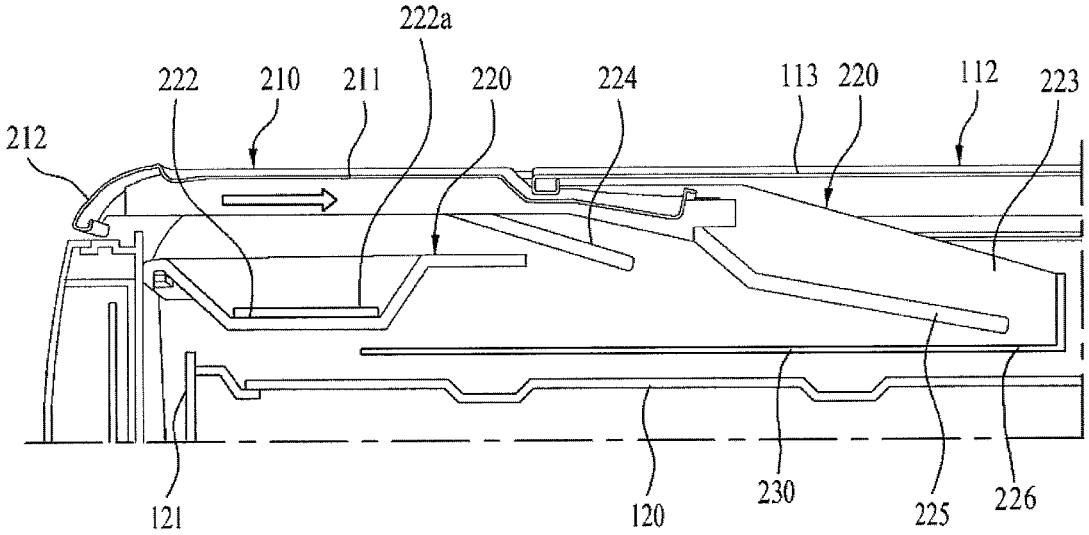
FIGS. 6 and 7 are partial cross-sectional views of the laundry drying apparatus showing opening and closing operations of the reception unit according to the embodiment.
Figure 7:
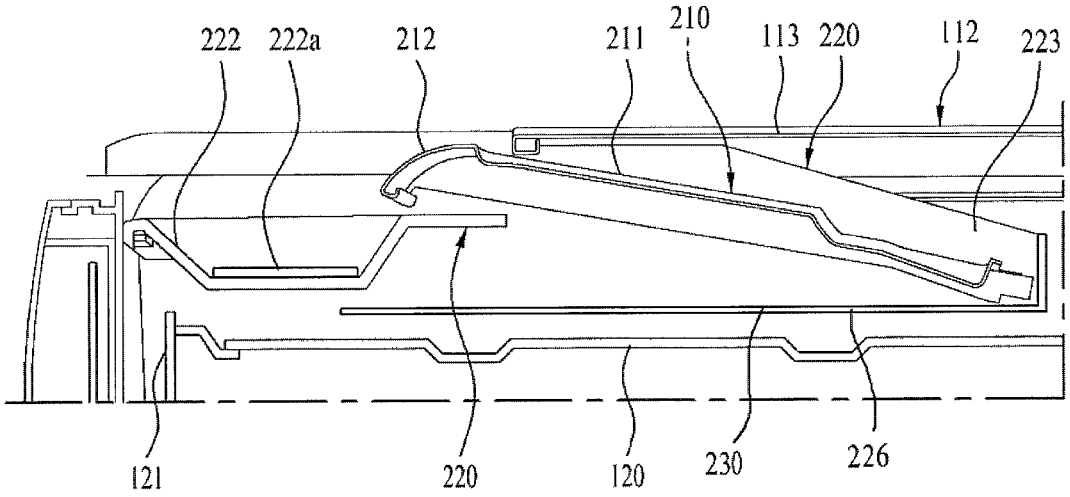

As shown in FIGS. 4 and 5, a reception unit or storage module 200 according to embodiments disclosed herein may include a reception bracket 220 provided in the laundry drying apparatus 100 and a sliding door 210, which may be guided by the reception bracket 220 and moved to a position under the upper cover 112 when the reception unit 200 is opened. The reception unit 200 and the upper cover 112 may be spaced apart from each other by a predetermined distance so as to allow the sliding door 210 of the reception unit 200 to be easily moved.

The sliding door 210 may be positioned at an upper surface of a front portion of the laundry drying apparatus 100 so as to be visible from the front portion of the upper cover 112. The outer surface of the sliding door 210 may be flush with an upper surface of the upper cover 112.

For example, the upper cover 112 may be provided at the upper surface thereof with the recessed surface 113 to reinforce the upper cover 112, and the sliding door 210 may be provided at the upper surface thereof with a recessed surface 211, which may be flush with the recessed surface 113 of the upper cover 112. Thus, the upper surface of the laundry drying apparatus 100 may exhibit a single recessed shape composed of the recessed surface 113 of the upper cover 112 and the recessed surface 211 of the sliding door 210.

The front edge of the sliding door 210 may be provided with a connecting surface 212, which may be continuous with a contour of the front cover 117 of the cabinet 110. The front edge of the sliding door 210 may form a front and upper edge of the laundry drying apparatus 110. The sliding door 210 may be provided at a front edge thereof with the connecting surface 212 having a predetermined curved shape, and the upper surface of the sliding door 210 may be continuous with the front surface of the front cover 117 via a curved surface of the connecting surface 212.

According to another embodiment disclosed herein, the connecting surface 212 of the sliding door 210 may be formed with an inclined surface having a predetermined angle of inclination. If the front edge of the sliding door 210 has an inclined surface, the front edge of the laundry drying apparatus 100 may be formed by the door 210, the connecting surface 212 and the front cover 117, whose surfaces may be flat or curved.

First and second slide protrusions 213 and 214, which may be guided by first and second guide slits 224 and 225 of the reception brackets 220, may be provided at lateral sides of the sliding door 210. The first and second slide protrusions 213 and 214 may be spaced apart from each other by a predetermined distance, and the second slide protrusion 214 may be provided behind the first slide protrusion 213.

The reception brackets 220 may include a body part or reception body 221, which may define a reception space, and guide parts or guides 223, which may be provided on or at lateral sides of the reception body 221 so as to slidably guide the sliding door 210.

The reception body 221 may be provided with a reception recess 222 for receiving objects. A plurality of ribs **222*a* to aid in restricting movement of objects received in the reception recess 222 may be provided on an inner surface of the reception recess 222**.

The guides 223 may be vertically provided at lateral side ends of the reception body 221 and may extend downward from the upper cover 112. First and second surfaces of the guides 223, which face each other, may be provided with the first and second guide slits 224 and 225, along which the first and second slide protrusions 213 may be guided and inserted.

The first and second guide slits 224 and 225 may be symmetrically formed in inner surfaces of the guides 223. The first guide slit 224 may be provided in front of the second guide slit 225. The first guide slit 224 and the second guide slit 225 may have different angles of inclination and may be inclined downward in the direction of the upper cover 112. The second guide slit 225 may have a greater angle of inclination than the first guide slit 224.

The first slide protrusion 213 may be inserted into the first guide slit 224, and the second slide protrusion 214 may be inserted into the second guide slit 225. When the sliding door 210 slides, the first and second protrusions 213 and 214 move along the first and second guide slits 224 and 225, respectively.

The first guide slit 224 and the second guide slit 225 may have different angles of inclination. Upper ends of the first and second guide slits 224 and 225 may extend such that the sliding door 210 may close the reception body 221 of the reception bracket 220 when the first and second slide protrusions 213 and 214, inserted in the first and second guide slits 224 and 225, are positioned at the upper ends of the first and second slits 224 and 225.

Lower ends of the first and second guide slits 224 and 225 may extend such that the sliding door 210 may open the reception body 221 of the reception bracket 220 and move under the upper cover 112 when the first and second slide protrusions 213 and 214, inserted into the first and second guide slits 224 and 225, are positioned at the lower ends of the first and second guide slits 224 and 225.

The sliding door 210 of the reception unit 200 may be constructed or configured so as to slide under the upper cover 112 when the reception body 221 is opened. That is, when the sliding door 210 is slid to a position under the upper cover 112, the sliding door 210 may come very close to an upper end of the drum 120.

The drum 120 may generate heat having a very high temperature for a period of time during or after the drying operation. The heat generated from the drum 120 may be transmitted to the sliding door 111 of the reception unit 200 and the reception bracket 220.

The sliding door 111 and the reception bracket 220 may form the reception unit 200. Although the sliding door 111 and the reception bracket 220 may be made of synthetic resin, which may be injection-molded and highly resistant to heat, the sliding door 111 and the reception bracket 220 may be deformed by the high-temperature heat generated in the drum 120.

Thus, a shielding plate 226 to prevent heat generated from the drum 120 from being transmitted to the reception bracket 220 and the sliding door 111 may be provided under the reception bracket 220 and the sliding door 111 of the reception unit 200. The shielding bracket may be coupled and spaced apart from both the reception bracket 220 and the sliding door 111 by a predetermined distance so as to decrease heat conductivity.

As heat generated in the drum 120 during or after the operation of the laundry drying apparatus 100 may not be transmitted to the reception bracket 220 or to the sliding door 111, it may be possible to prevent thermal distortion or deformation of the reception bracket 220 and the sliding door 111. Furthermore, if a fire breaks out in the laundry drying apparatus 100 due to a malfunction or erroneous operation, the shielding plate 226 may be able to prevent the fire in the laundry drying apparatus 100 from spreading outside.

Figure 8:
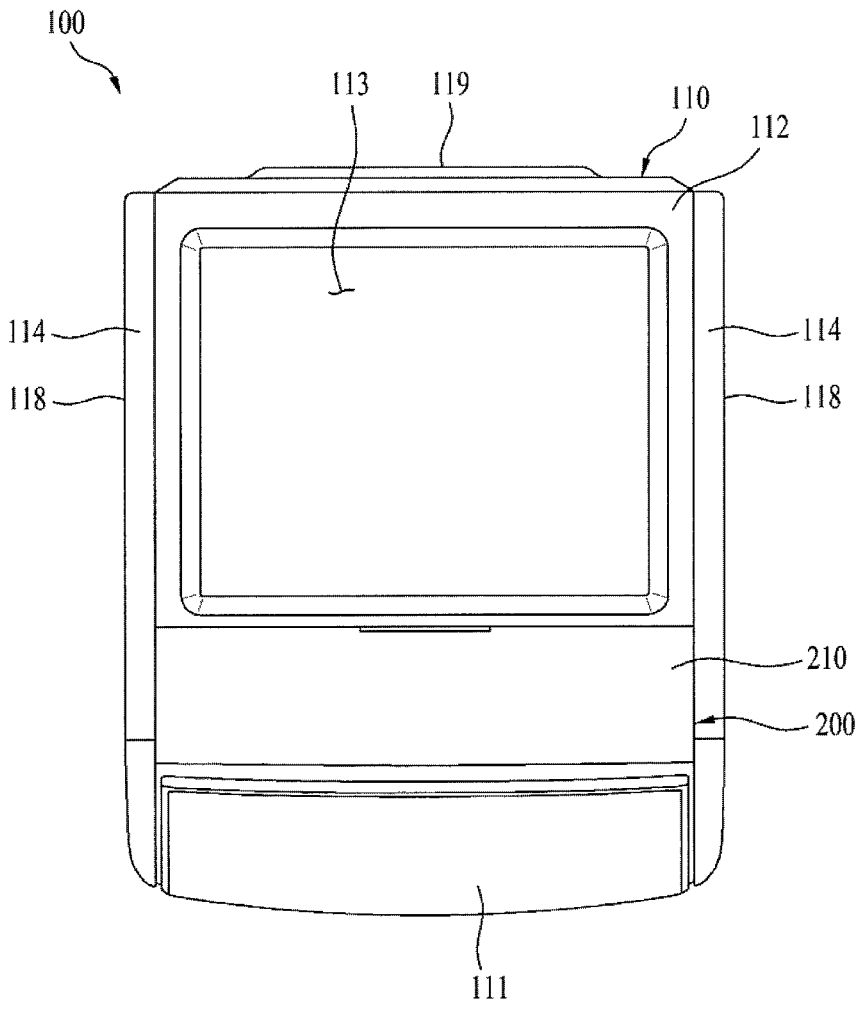
FIGS. 8 and 9 are plan views of the laundry drying apparatus showing the opening and closing operations of the reception unit according to the embodiment.

In one state or position of the reception unit 200, the reception unit 200 may close the reception recess 222 of the reception bracket 220. That is, the sliding door 210 of the reception unit 200 may be removed from the position under the upper cover 112 and may be positioned over the reception bracket 220, as shown in FIG. 8. The first and second slide protrusions 213 and 214 formed on lateral sides of the sliding door 210 may be positioned at the upper ends of the first and second guide slits 224 and 225, and the front edge of the sliding door 210 may form the front and upper edge of the laundry drying apparatus 100.

When the sliding door 210 of the reception unit 200 is pushed toward the upper cover 112 in order to open the reception recess 222, the first and second slide protrusions 213 and 214 of the sliding door 210 may move along the first and second guide slits 224 and 225 formed in the guides 223 of the reception bracket 220, and the sliding door 210 may move accordingly.

Figure 9:
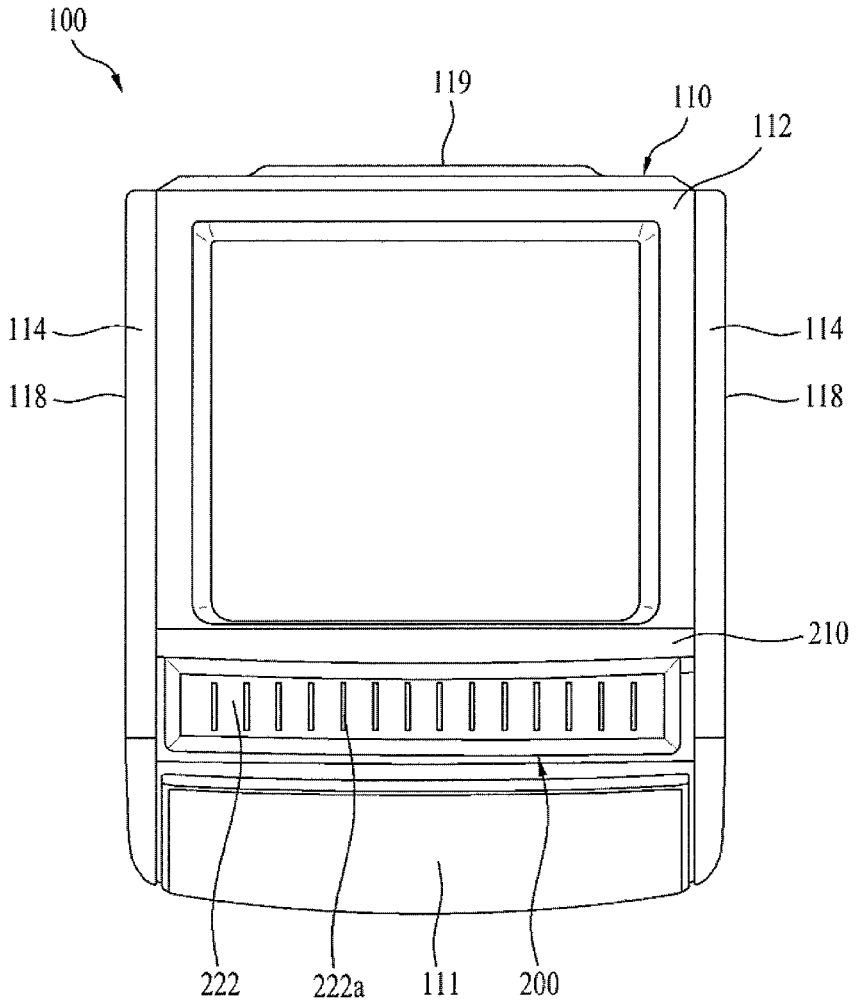

The first and second guide slits 224 and 225 may be configured to incline downward as the first and second guide slits 224 and 225 move toward the upper cover 112. Accordingly, as the sliding door 210 moves under the upper cover 112, the reception recess 222 of the reception bracket 220 may be opened, as shown in FIG. 9.

The laundry drying apparatus 100 according to embodiments disclosed herein, which may be constructed or configured as described above, may be provided on the upper surface thereof with the reception unit 200, thereby enabling a user to easily store objects.

The laundry drying apparatus 100 according to embodiments disclosed herein may be able to prevent heat generated from the drum 120 during drying from being transmitted to the sliding door 111, thereby preventing the reception unit 200 and the sliding door 111 of the reception unit 200 from being damaged by the heat.

As the upper cover 112 and the reception unit 200, which may define the upper surface of the laundry drying apparatus 100, may be configured to be continuous with each other, the upper surface of the laundry drying apparatus 100 may look like an integral component and may have a neat appearance.

As the laundry drying apparatus 100 may be provided with an additional reception space, the laundry drying apparatus 100 according to embodiments disclosed herein may be able to separately store items required for or utilized in washing/drying operations or extraneous substances that may be separated from items or clothes during drying.

A laundry drying apparatus, which may be provided with an additional reception space for separate storage of items required for washing/drying operations or extraneous substances generated from items or clothes during drying, may be provided.

Embodiments disclosed herein provide a laundry drying apparatus that may include a cabinet including an upper cover, a drum disposed or provided in the cabinet, an air supply unit configured to supply air to the drum and recover air from the drum, a reception unit that defines an upper surface of the cabinet together with the upper cover, and a reception space provided in the reception unit.

The laundry drying apparatus may further include a shielding plate provided between the drum and the reception unit.

According to embodiments disclosed herein, the reception unit may be moved under the upper cover so as to open the reception space. The reception unit may include at least one reception bracket provided over the drum, and a sliding door configured to slidably couple to or communicate with the at least one reception bracket so as to open and close the reception space.

The at least one reception bracket may include a reception body configured to define the reception space, a plurality of guides provided on lateral sides of the reception body, and a plurality of guide slits provided on inner facing surfaces of the guides to guide the sliding door. The sliding door may include a plurality of slide protrusions formed at lateral sides thereof configured to be inserted in the plurality of guide slits.

The plurality of guide slits may be inclined downward in a direction away from the upper cover. The plurality of guide slits may include a first guide slit and a second guide slit on each of the inner facing surfaces of the plurality of guides, and the plurality of slide protrusions may include a first slide protrusion and a second slide protrusion on each of the lateral sides of the sliding door.

The second guide slit may have a greater angle of inclination than the first guide slit on each of the inner facing surfaces of the plurality of guides.

A front edge of the sliding door may form a front edge of the cabinet, and a connecting surface may be provided between an upper surface of the sliding door and a front cover of the cabinet so as to connect the upper surface of the sliding door to the front cover of the cabinet.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry drying apparatus comprising:

a cabinet that includes an upper cover forming a rear portion of an upper surface of the cabinet to expose an upper area of the cabinet;

a drum provided in the cabinet;

an air supply unit configured to supply air to the drum and recover air from the drum;

a reception bracket provided over a front portion of the drum and provided in the upper area exposed by the upper cover and which has therein a reception recess, the reception bracket being fixed to the upper cover;

a sliding door that defines a front portion of the upper surface of the cabinet, together with the upper cover, and coupled to the reception bracket that slides to open and close an upper surface of the reception recess exposed by the upper cover and formed in the front portion of the upper surface of the cabinet; and a shielding plate provided between the drum and the reception bracket that prevents heat generated from the drum from being directly transmitted to the reception bracket, wherein the sliding door is movable to a position between the upper cover and the shielding plate so as to open the reception recess, is slidably coupled to the reception bracket, and is adapted to slide downward to open the reception recess, and wherein the reception bracket remains stationary when the sliding door is moved to the position between the upper cover and the shielding plate.

2. The laundry drying apparatus according to claim 1, wherein the reception bracket includes:

a reception body configured to define the reception recess;

a plurality of guides provided on lateral sides of the reception body; and a plurality of guide slits provided on inner facing surfaces of the guides to guide the sliding door, wherein the sliding door includes a plurality of slide protrusions formed at lateral sides thereof configured to be inserted in the plurality of guide slits.

3. The laundry drying apparatus according to claim 2, wherein the plurality of guide slits are inclined downward in a direction away from the upper cover.

4. The laundry drying apparatus according to claim 3, wherein the plurality of guide slits includes a first guide slit and a second guide slit on each of the inner facing surfaces of the plurality of guides, and wherein the plurality of slide protrusions includes a first slide protrusion and a second slide protrusion on each of the lateral sides of the sliding door.

5. The laundry drying apparatus according to claim 4, wherein the second guide slit has a greater angle of inclination than the first guide slit on each of the inner facing surfaces of the plurality of guides.

6. The laundry drying apparatus according to claim 1, wherein a front edge of the sliding door forms a front edge of the cabinet.

7. A laundry drying apparatus comprising:

a cabinet comprising an upper cover that forms a rear portion of an upper surface of the cabinet;

a drum provided in the cabinet;

an air supply unit configured to supply air to the drum and receive air from the drum;

a reception bracket provided over the drum and attached to the upper cover, the reception bracket including a first guide slit that is angled downward toward a rear of the cabinet at a first angle and a second guide slit provided behind the first guide slit and angled downward toward the rear of the cabinet at a second angle greater than the first angle; and a sliding door that defines a front portion of the upper surface of the cabinet, the sliding door being coupled to the reception bracket so as to open and close a reception recess provided below the front portion of the upper cover, wherein the sliding door comprises:

a first slide protrusion that extends laterally from a side of the sliding door and is configured to be inserted into and slide along the first guide slit; and a second slide protrusion that extends laterally from the side of the sliding door and is provided behind the first slide protrusion, the second slide protrusion configured to be inserted into and slid along the second guide slit.

8. The laundry drying apparatus according to claim 7, wherein the reception bracket remains stationary when the sliding door is moved to the position between the upper cover and the shielding plate.

9. The laundry drying apparatus according to claim 7, wherein the reception bracket includes:

a reception body configured to define the reception recess;

a plurality of guides provided on lateral sides of the reception body; and the first and second guide slits provided on inner facing surfaces of the guides to guide the sliding door, wherein the sliding door includes the first and second slide protrusions formed at lateral sides thereof configured to be inserted in the first and second guide slits.

10. The laundry drying apparatus according to claim 9, wherein the reception body comprises a base that connects lower edges of the plurality of guides to each other, and a plurality of ribs arranged in a first direction and provided on a top of the base, the first direction being parallel to a rotation axis of the drum.

* * * * *